US007278793B2

(12) United States Patent
Sawai

(10) Patent No.: US 7,278,793 B2
(45) Date of Patent: Oct. 9, 2007

(54) IMAGE GENERATING APPARATUS

(75) Inventor: Kunio Sawai, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 0 days.

(21) Appl. No.: 11/387,869

(22) Filed: Mar. 24, 2006

(65) Prior Publication Data

US 2006/0233581 A1 Oct. 19, 2006

(30) Foreign Application Priority Data

Apr. 19, 2005 (JP) ..... 2005-121617

(51) Int. Cl.
*B41J 25/312* (2006.01)
*B41J 25/304* (2006.01)
*B41J 11/00* (2006.01)

(52) U.S. Cl. ..... 400/120.16; 347/220

(58) Field of Classification Search ..... 400/120.16; *B41J 25/312, 25/304*

See application file for complete search history.

(56) References Cited

U.S. PATENT DOCUMENTS 4,715,737 A * 12/1987 Hori ..... 400/569
4,832,517 A * 5/1989 Minaminaka ..... 400/185
5,354,136 A * 10/1994 Takizawa et al. ..... 400/185
5,447,382 A * 9/1995 Yui et al. ..... 400/207
5,672,017 A * 9/1997 Taniguchi ..... 400/120.16
2005/0225625 A1* 10/2005 Sawai ..... 347/220

FOREIGN PATENT DOCUMENTS

| | | |
|---|---|---|
| JP | 62-139658 U | 9/1987 |
| JP | 5-286198 A | 11/1993 |
| JP | 6-15852 A | 1/1994 |
| JP | 9-188027 A | 7/1997 |
| JP | 9-188029 A | 7/1997 |

* cited by examiner

*Primary Examiner*—Michael Cygan
*Assistant Examiner*—Jonathan Dunlap
(74) *Attorney, Agent, or Firm*—Crowell & Moring LLP

(57) ABSTRACT

An image generating apparatus capable of rotating a pressing member pressing a print head against a platen roller at a large rotation angle with a cam is obtained. This thermal transfer printer (image generating apparatus) comprises a drive cam for driving the pressing member. This drive cam includes a cardioid cam engaging with a cam pin provided on the pressing member and a protrusion, constituted of a first protrusion and a second protrusion, for restraining the cam pin from moving by force other than that of the drive cam.

14 Claims, 8 Drawing Sheets

IMAGE GENERATING APPARATUS

BACKGROUND OF THE INVENTION

1. Field of the Invention

The present invention relates to an image generating apparatus, and more particularly, it relates to an image generating apparatus comprising a print head for printing.

2. Description of the Background Art

An image generating apparatus actuating a pressing mechanism for pressing a print head against a platen roller with a gear train or a link mechanism is known in general, as disclosed in Japanese Utility Model Laying-Open No. 62-139658 (1987), Japanese Patent Laying-Open No. 9-188027 (1997) or Japanese Patent Laying-Open No. 9-188029 (1997), for example.

The aforementioned Japanese Utility Model Laying-Open No. 62-139658 discloses a thermal printer (image generating apparatus) having an arm, employed for rocking a thermal head (print head), mounted on a gear to interlock with rotation of the gear by coming into contact with a pin provided on the gear, for pressing the print head against a platen roller by rotating the gear with a stepping motor. This thermal printer applies a constant torque pressure to the print head by transmitting the same between the stepping motor and the gear mounted with the arm with a friction clutch. This friction clutch comprises a gear, a spring for producing frictional force and a spring clamp for clamping the spring.

The aforementioned Japanese Patent Laying-Open No. 9-188027 discloses a thermal transfer printer (image generating apparatus) actuating a link mechanism through rotation of a cam for applying a constant load resulting from a tension spring to a line thermal head and further rotating the cam thereby driving another mechanism. The link mechanism of this thermal transfer printer comprises a link portion formed by first and second links for pressing a print head against a platen roller, a crank driving the link portion, a pressure arm having the tension spring for applying pressing force to the link portion and the cam for driving the crank.

The aforementioned Japanese Patent Laying-Open No. 9-9-188029 discloses a pressure support engaging a locking pin of a locking lever with a notched hole provided on a first end of an L arm thereby coupling the L arm with a print head and applying a spring load of a tension spring mounted on a second end of the L arm as pressing force for pressing the print head against a platen roller. This pressure support additionally comprises a pressure switching cam mechanism since the same cannot be switched between a pressing position engaging the locking pin with the notched hole of the L arm and a pressing release position disengaging the locking pin from the notched hole of the L arm with only a pressing member formed by the L arm.

However, the conventional image generating apparatus described in the aforementioned Japanese Utility Model Laying-Open No. 62-139658, Japanese Patent Laying-Open No. 9-188027 or Japanese Patent Laying-Open No. 9-188029 actuating the pressing mechanism pressing the print head against the platen roller with the gear train or the link mechanism must be provided with the friction clutch (Japanese Utility Model Laying-Open No. 62-139658) constituted of large numbers of gear trains and components, the link mechanism (Japanese Patent Laying-Open No. 9-188027) having a complicated structure or the pressure switching cam mechanism (Japanese Patent Laying-Open No. 9-188029) independent of the L arm and the spring forming the pressing mechanism. Therefore, the number of components is increased, and the structure is complicated.

In this regard, there has been proposed an image generating apparatus whose structure is simplified by directly employing a cam for pressing a print head against a platen roller without a link mechanism or the like, as disclosed in Japanese Patent Laying-Open No. 5-286198 (1993) or Japanese Patent Laying-Open No. 6-15852 (1994), for example.

The aforementioned Japanese Patent Laying-Open No. 5-286198 discloses a thermal transfer printer (image generating apparatus) provided with a spring and a stopper between a print head pressing lever and a print head for integrally actuating the print head pressing lever and the print head and pressing the print head against a platen roller by rotating the print head pressing lever with the cam. When a cam pin of the print head pressing lever engaging with the cam reaches the outer periphery of the cam in this thermal transfer printer, the print head separates from the platen roller due to rotation of the print head pressing lever. When the cam pin of the print head pressing lever reaches the inner periphery of the cam, on the other hand, the print head comes into contact with the platen roller due to rotation of the print head pressing lever while the print head pressing lever and the stopper provided on a print head lever separate from each other, so that the print head is pressed against the platen roller due to urging force of a compression spring provided on the print head pressing lever. Thus, the print head rotates by the difference between the radial lengths of the outer and inner peripheries of a cam groove in the thermal transfer printer according to Japanese Patent Laying-Open No. 5-286198.

The aforementioned Japanese Patent Laying-Open No. 6-15852 discloses a printer capable of pressing and separating a print head against and from a platen roller with a cam and an L arm. When a cam pin of the L arm engaging with the cam reaches the outer periphery of the cam in this printer, a pin provided on the L arm and a print head lever come into contact with each other so that the L arm lifts up the print head lever. Thus, the print head is separated from the platen roller. When the cam pin of the L arm engaging with the cam reaches the inner periphery of the cam, on the other hand, the pin provided on the L arm and the print head lever separate from each other so that the spring load of a torsion spring provided between the L arm and the print head lever is applied to the print head. Thus, the print head is pressed against the platen roller. Also in the printer according to Japanese Patent Laying-Open No. 6-15852, the print head rotates by the difference between the radial lengths of the outer and inner peripheries of a cam groove.

In the thermal transfer printer (printer) disclosed in the aforementioned Japanese Patent Laying-Open No. 5-286198 or 6-15852, however, the print head is pressed against the platen roller with the general cam, and hence the rotational angle of the print head disadvantageously substantially corresponds to the radius of the print head. Consequently, the cam is disadvantageously hard to use when it is intended to actuate the print head at a large rotational angle exceeding the radius of the cam.

SUMMARY OF THE INVENTION

The present invention has been proposed in order to solve the aforementioned problems, and an object of the present invention is to provide an image generating apparatus capable of rotating a pressing member pressing a print head against a platen roller at a large rotation angle with a cam.

An image generating apparatus according to a first aspect of the present invention comprises a print head for printing, a platen roller opposed to the print head, a rotatably supported pressing member, having a cam pin, for pressing the print head against the platen roller by pressing the upper portion of the print head and a drive cam for driving the pressing member, while the drive cam includes a cardioid cam engaging with the cam pin provided on the pressing member and a movement control member for restraining the cam pin from moving by force other than that of the drive cam when the cam pin reaches a prescribed position of the cardioid cam.

In this image generating apparatus according to the first aspect, as hereinabove described, the drive cam includes the cardioid cam engaging with the cam pin provided on the pressing member so that the cam pin of the pressing member moves from the outer periphery of the drive cam toward the inner periphery thereof and further moves from the inner periphery of the drive cam toward the outer periphery thereof along another cam opposite to that employed for this movement, whereby the pressing member can be rotated at a rotational angle substantially corresponding to the diameter of the drive cam. Thus, the rotational angle of the pressing member can be increased beyond that of a general cam, whereby the pressing member pressing the print head against the platen roller can be rotated at a large rotational angle with the cam. Further, the drive cam includes the movement control member for restraining the cam pin from moving (deviating) by force other than that of the drive cam when the cam pin reaches the prescribed position of the cardioid cam, whereby the cam pin can be restrained from moving on the prescribed position where the cam pin is released from the cardioid cam. Thus, the cam pin can be undeviatingly moved along the cardioid cam also when external force other than that of the drive cam is applied to the cam pin.

In the aforementioned image generating apparatus according to the first aspect, the movement control member of the drive cam is preferably a protrusion provided on the side surface of the drive cam, and the pressing member preferably includes a contact portion coming into contact with the protrusion of the drive cam, so that the contact portion of the pressing member comes into contact with the protrusion thereby restraining the cam pin provided on the pressing member from moving on the prescribed position. According to this structure, the pressing member can be restrained from moving on the prescribed position, where the cam pin of the pressing member is released from the cardioid cam, with the protrusion of the drive cam. Thus, the pressing member can be correctly driven with the cardioid cam employed for obtaining a large rotational angle, whereby the pressing member can be correctly rotated at a large rotational angle about a support rod. Consequently, the print head can be correctly pressed against the platen roller at a large rotational angle.

In the aforementioned image generating apparatus according to the first aspect, the protrusion preferably includes a first protrusion for restraining the cam pin from moving in a first direction on the prescribed position of the cardioid cam and a second protrusion for restraining the cam pin from moving in a second direction on the prescribed position of the cardioid cam. According to this structure, the cam pin of the pressing member can be restrained from moving on each of two prescribed positions where the cam pin is released from the cardioid cam. Therefore, the cam pin can be restrained from moving by force other than that of the drive cam on the two prescribed positions where the cam pin is released from the cardioid cam, whereby the cam pin can be more correctly moved along the cardioid cam capable of obtaining a large rotational angle. Consequently, the pressing member can be more correctly rotated at a large rotational angle, whereby the print head can be more correctly pressed against the platen roller at a large rotational angle.

In the aforementioned image generating apparatus according to the first aspect, the protrusion is preferably integrally formed with the drive cam. According to this structure, the number of components can be inhibited from increase despite the provision of the protrusion.

In the aforementioned image generating apparatus according to the first aspect, the cardioid cam preferably includes a cardioid cam groove provided on the side surface of the drive cam, and a first gear is preferably formed on the outer periphery of the drive cam. According to this structure, the drive cam can be employed as a gear, whereby driving force of a motor can be easily transmitted to the drive cam.

In the aforementioned image generating apparatus according to the first aspect, the cardioid cam preferably includes a first cam moving the cam pin provided on the pressing member from the outer periphery of the drive cam toward the inner periphery thereof, a second cam moving the cam pin provided on the pressing member from the inner periphery of the drive cam toward the outer periphery thereof and a coupling portion coupling the first cam and the second cam with each other. According to this structure, the cam pin provided on the pressing member can be moved from the outer periphery of the drive cam toward the inner periphery thereof with the first cam and further moved from the inner periphery of the drive cam toward the outer periphery thereof with the second cam, whereby the pressing member can be rotated at a large rotational angle substantially corresponding to the diameter of the drive cam.

In this case, the prescribed position for the cam pin where the contact portion of the pressing member comes into contact with the protrusion is preferably the position of the coupling portion of the cardioid cam. According to this structure, the cam pin is released from the cardioid cam on the coupling portion of the cardioid cam, whereby the cam pin can be easily restrained from moving (deviating) by force other than that of the drive cam by bringing the contact portion of the pressing member into contact with the protrusion on this position of the coupling portion.

In the aforementioned image generating apparatus having the first protrusion and the second protrusion, the first protrusion and the second protrusion are preferably arranged on the side surface of the drive cam to be opposed to each other through the rotation center of the drive cam. When the first and second protrusions are arranged in this manner, the contact portion of the pressing member can be easily brought into contact with the first and second protrusions on the positions where the cam pin moves in the first and second directions respectively, whereby the cam pin can be more easily restrained from moving by force other than that of the drive cam upon release from the cardioid cam.

In the aforementioned image generating apparatus having the drive cam integrally formed with the protrusion, the drive cam is preferably made of resin. According to this structure, the protrusion can be easily formed integrally with the drive cam by resin molding.

The aforementioned image generating apparatus having the first gear formed on the outer periphery of the drive cam preferably further comprises a second gear meshing with the first gear formed on the outer periphery of the drive cam, for rotating the drive cam by transmitting rotation of the second gear to the first gear of the drive cam. According to this structure, rotation of the second gear can be easily transmitted to the first gear of the drive cam, whereby the drive cam can be more easily rotated through rotation of the second gear.

An image generating apparatus according to a second aspect of the present invention comprises a print head for printing, a platen roller opposed to the print head, a rotatably supported pressing member, having a cam pin, for pressing the print head against the platen roller by pressing the upper portion of the print head and a drive cam for driving the pressing member, the drive cam includes a cardioid cam engaging with the cam pin provided on the pressing member and a movement control member for restraining the cam pin from moving by force other than that of the drive cam when the cam pin reaches a prescribed position of the cardioid cam, the movement control member of the drive cam is a protrusion, integrally provided on the side surface of the drive cam, including a first protrusion for restraining the cam pin from moving in a first direction on the prescribed position of the cardioid cam and a second protrusion for restraining the cam pin from moving in a second direction on the prescribed position of the cardioid cam, the pressing member includes a contact portion coming into contact with the protrusion of the drive cam so that the contact portion of the pressing member comes into contact with the protrusion thereby restraining the cam pin provided on the pressing member from moving on the prescribed position, the cardioid cam includes a cardioid cam groove provided on the side surface of the drive cam, and a first gear is formed on the outer periphery of the drive cam.

In this image generating apparatus according to the second aspect, as hereinabove described, the drive cam includes the cardioid cam engaging with the cam pin provided on the pressing member so that the cam pin of the pressing member moves from the outer periphery of the drive cam toward the inner periphery thereof and further moves from the inner periphery of the drive cam toward the outer periphery thereof along another cam opposite to that employed for this movement, whereby the pressing member can be rotated at a rotational angle substantially corresponding to the diameter of the drive cam. Thus, the rotational angle of the pressing member can be increased beyond that of a general cam, whereby the pressing member pressing the print head against the platen roller can be rotated at a large rotational angle with the cam. Further, the drive cam includes the movement control member for restraining the cam pin from moving by force other than that of the drive cam when the cam pin reaches the prescribed position of the cardioid cam, whereby the cam pin can be restrained from moving (deviating) on the prescribed position where the cam pin is released from the cardioid cam. Thus, the cam pin can be undeviatingly moved along the cardioid cam also when external force other than that of the drive cam is applied to the cam pin. Further, the movement control member for the drive cam is constituted of the protrusion provided on the side surface of the drive cam and the pressing member includes the contact portion coming into contact with the protrusion of the drive cam so that the contact portion of the pressing member comes into contact with the protrusion thereby restraining the cam pin provided on the pressing member from moving on the prescribed position, whereby the pressing member can be restrained from moving on the prescribed position where the cam pin of the pressing member is released from the cardioid cam. Thus, the pressing member can be correctly driven with the cardioid cam employed for obtaining a large rotational angle, whereby the pressing member can be correctly rotated at a large rotational angle about a support rod. Consequently, the print head can be correctly pressed against the platen roller at a large rotational angle. In addition, the protrusion includes the first protrusion for restraining the cam pin from moving in the first direction on the prescribed position of the cardioid cam and the second protrusion for restraining the cam pin from moving in the second direction on the prescribed position of the cardioid cam, whereby the cam pin can be restrained from moving on each of two prescribed positions where the cam pin of the pressing member is released from the cardioid cam. Therefore, the cam pin of the pressing member can be restrained from moving by force other than that of the drive cam on the two prescribed positions where the cam pin is released from the cardioid cam, whereby the cam pin can be more correctly moved along the cardioid cam capable of obtaining a large rotational angle. Consequently, the pressing member can be more correctly rotated at a large rotational angle, whereby the print head can be more correctly pressed against the platen roller at a large rotational angle. Further, the protrusion is so integrally formed with the drive cam that the number of components can be inhibited from increase despite the provision of the protrusion. Further, the cardioid cam includes the cardioid cam groove provided on the side surface of the drive cam and the first gear is formed on the outer periphery of the drive cam so that the drive cam can be employed as a gear, whereby driving force of a motor can be easily transmitted to the drive cam.

In the aforementioned image generating apparatus according to the second aspect, the cardioid cam preferably includes a first cam moving the cam pin provided on the pressing member from the outer periphery of the drive cam toward the inner periphery thereof, a second cam moving the cam pin provided on the pressing member from the inner periphery of the drive cam toward the outer periphery thereof and a coupling portion coupling the first cam and the second cam with each other. According to this structure, the cam pin provided on the pressing member can be moved from the outer periphery of the drive cam toward the inner periphery thereof with the first cam and further moved from the inner periphery of the drive cam toward the outer periphery thereof with the second cam, whereby the pressing member can be rotated at a large rotational angle substantially corresponding to the diameter of the drive cam.

In this case, the prescribed position for the cam pin where the contact portion of the pressing member comes into contact with the protrusion is preferably the position of the coupling portion of the cardioid cam. According to this structure, the cam pin is released from the cardioid cam on the coupling portion of the cardioid cam, whereby the cam pin can be easily restrained from moving (deviating) by force other than that of the drive cam by bringing the contact portion of the pressing member into contact with the protrusion on this position of the coupling portion.

In the aforementioned image generating apparatus according to the second aspect, the first protrusion and the second protrusion are preferably arranged on the side surface of the drive cam to be opposed to each other through the rotation center of the drive cam. When the first and second protrusions are arranged in this manner, the contact portion of the pressing member can be easily brought into contact with the first and second protrusions on the positions where the cam pin moves in the first and second directions respectively, whereby the cam pin can be more easily restrained from moving by force other than that of the drive cam upon release from the cardioid cam.

In the aforementioned image generating apparatus according to the second aspect, the drive cam is preferably made of resin. According to this structure, the protrusion can be easily formed integrally with the drive cam by resin molding.

The aforementioned image generating apparatus according to the second aspect preferably further comprises a second gear meshing with the first gear formed on the outer periphery of the drive cam, for rotating the drive cam by transmitting rotation of the second gear to the first gear of the drive cam. According to this structure, rotation of the second gear can be easily transmitted to the first gear of the drive cam, whereby the drive cam can be more easily rotated through rotation of the second gear.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
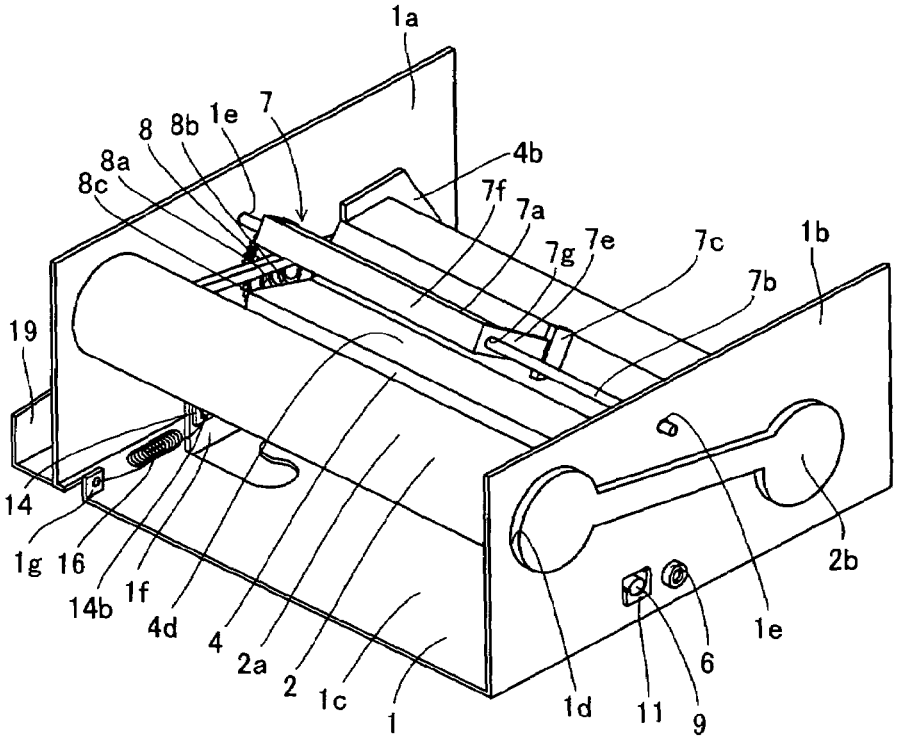
FIG. 1 is a perspective view showing the overall structure of a thermal transfer printer according to an embodiment of the present invention.

An embodiment of the present invention is now described with reference to the drawings.

A thermal transfer printer according to the embodiment of the present invention is described with reference to FIGS. 1 to 15. This embodiment of the present invention is applied to the thermal transfer printer, i.e., an exemplary image generating apparatus.

As shown in FIGS. 1 to 3, 5 and 6, the thermal transfer printer according to this embodiment comprises a metal chassis 1, an ink ribbon cartridge 2, a take-up reel 3, a print head 4 for printing, a platen roller 5 (see FIG. 8) opposed to the print head 4, a platen roller bearing 6 rotatably supporting the platen roller 5, a pressing member 7, a resin drive cam 8 driving the pressing member 7, a metal feed roller 9 for carrying paper, a metal press roller 10 pressed against the feed roller 9 with prescribed pressing force, feed roller bearings 11 and 12 rotatably supporting the feed roller 9, bearing support plates 14, a torsion coil spring 15 (see FIGS. 3 and 10), a tension coil spring 16, a motor 17 (see FIG. 3) for driving the feed roller 9 and the take-up reel 3, another motor 18 (see FIG. 6) for rotating the drive cam 8 driving the pressing member 7, a motor bracket 19, a feed roller gear 20 (see FIG. 5), a rocking gear 21 (see FIG. 5), intermediate gears 22, 23 and 24 and a small diameter gear 25. The small diameter gear 25 is an example of the "second gear" in the present invention.

Figure 2:
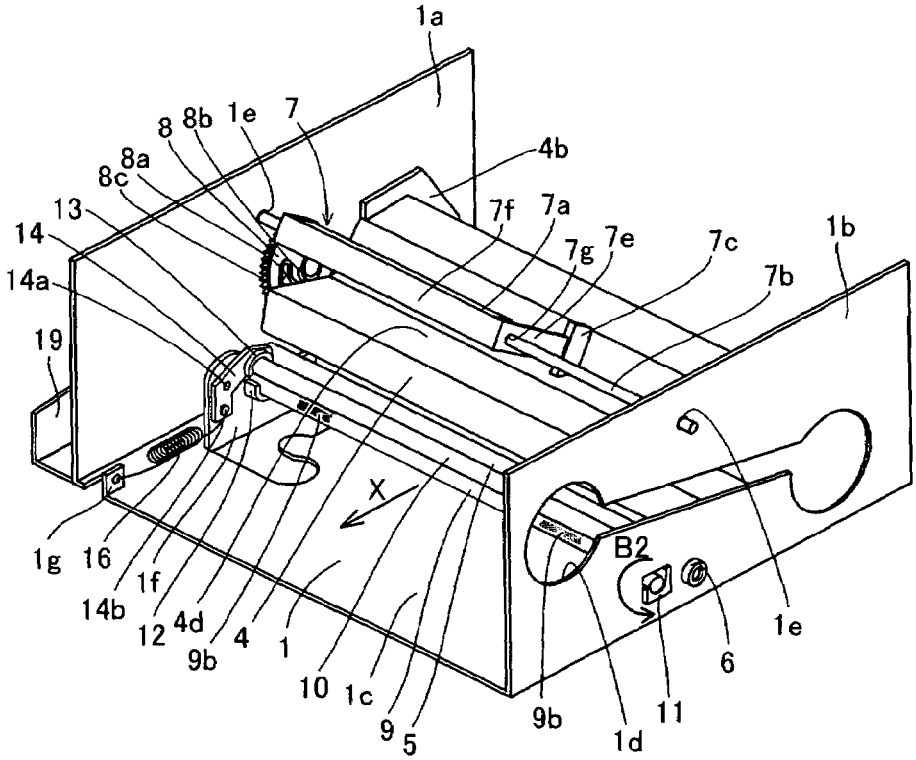
FIG. 2 is a perspective view of the thermal transfer printer according to the embodiment shown in FIG. 1, from which an ink ribbon cartridge is removed.

As shown in FIGS. 1 and 2, the chassis 1 has a first side surface 1*a*, a second side surface 1*b* and a bottom surface 1*c*. The aforementioned motor bracket 19 is mounted on the first side surface 1*a* of the chassis 1. A cartridge hole 1*d* for receiving the ink ribbon cartridge 2 is provided on the second side surface 1*b* of the chassis 1 opposed to the first side surface 1*a*. Receiving holes 1*e* rotatably supporting the pressing member 7 are provided on the first and second side surfaces 1*a* and 1*b* of the chassis 1 respectively. A bent section 1*f* is provided on the bottom surface 1*c* of the chassis 1 by partially uprighting the bottom surface 1*c*, in order to support the feed roller bearing 12. A spring clip 1*g* is provided on the bottom surface 1*c* of the chassis 1 so that a first end of the tension coil spring 16 is mounted thereon, as shown in FIGS. 1 and 2.

Figure 5:
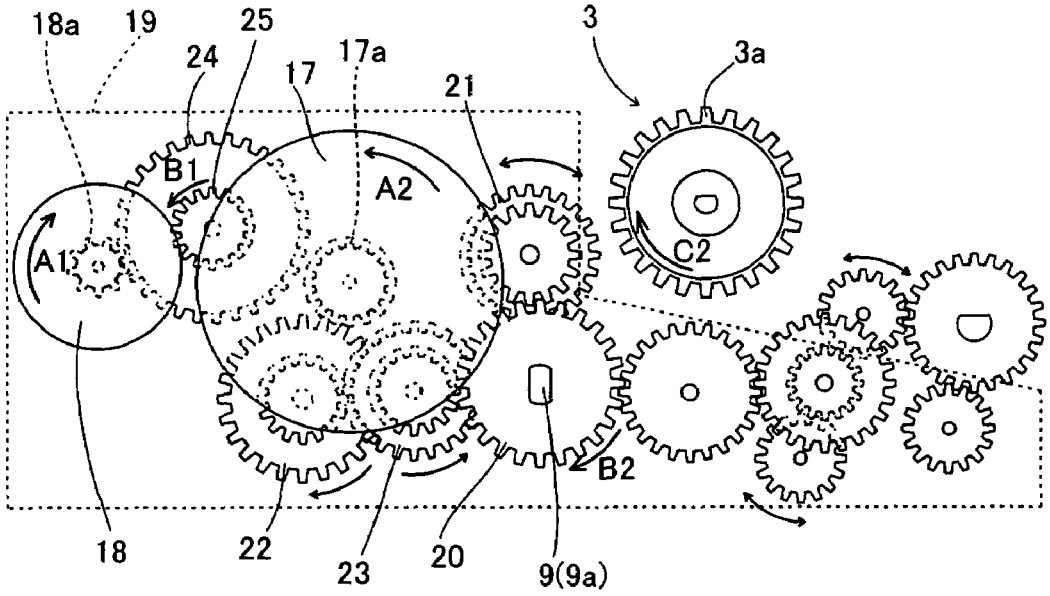
FIG. 5 is a front elevational view showing motors and gears of the thermal transfer printer according to the embodiment shown in FIG. 1.

The ink ribbon cartridge 2 has a take-up portion 2*a* and a feed portion 2*b*, as shown in FIG. 1. A take-up bobbin (not shown) and a feed bobbin (not shown) are arranged in the take-up portion 2*a* and the feed portion 2*b* of the ink ribbon cartridge 2 respectively. An ink ribbon is wound on the take-up bobbin and the feed bobbin, and the take-up bobbin takes up the ink ribbon wound on the same and the feed bobbin by engaging with the take-up reel 3 (see FIG. 6). As shown in FIG. 5, a gear 3*a* of the take-up reel 3 is so arranged that the rocking gear 21 regularly meshing with the feed roller gear 20 rocks to mesh with the same.

Figure 3:
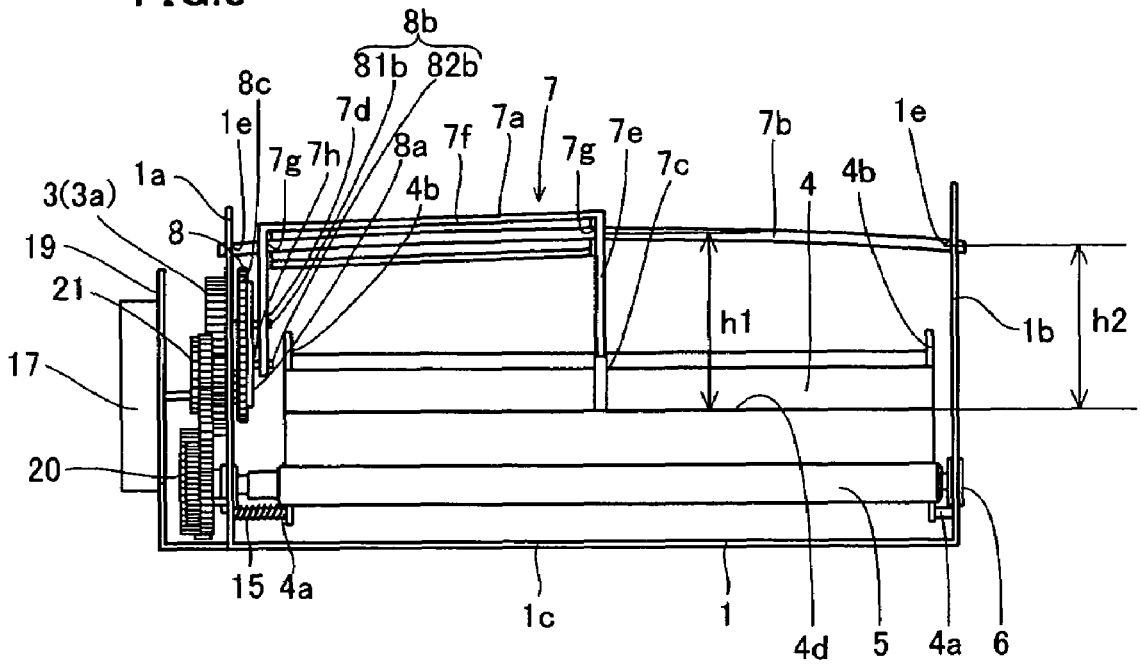
FIG. 3 is a front elevational view of the thermal transfer printer according to the embodiment shown in FIG. 1, from which the ink ribbon cartridge is removed.
Figure 8:
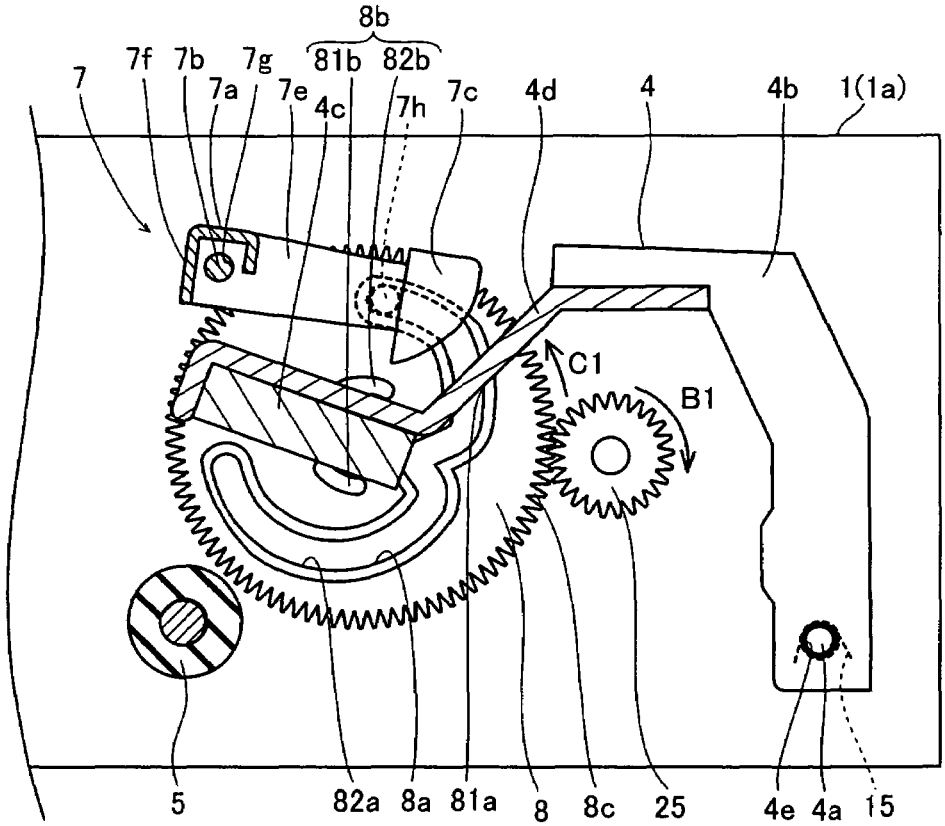
FIGS. 8 and 9 are sectional views of the pressing member of the thermal transfer printer according to the embodiment shown in FIG. 1.
Figure 9:
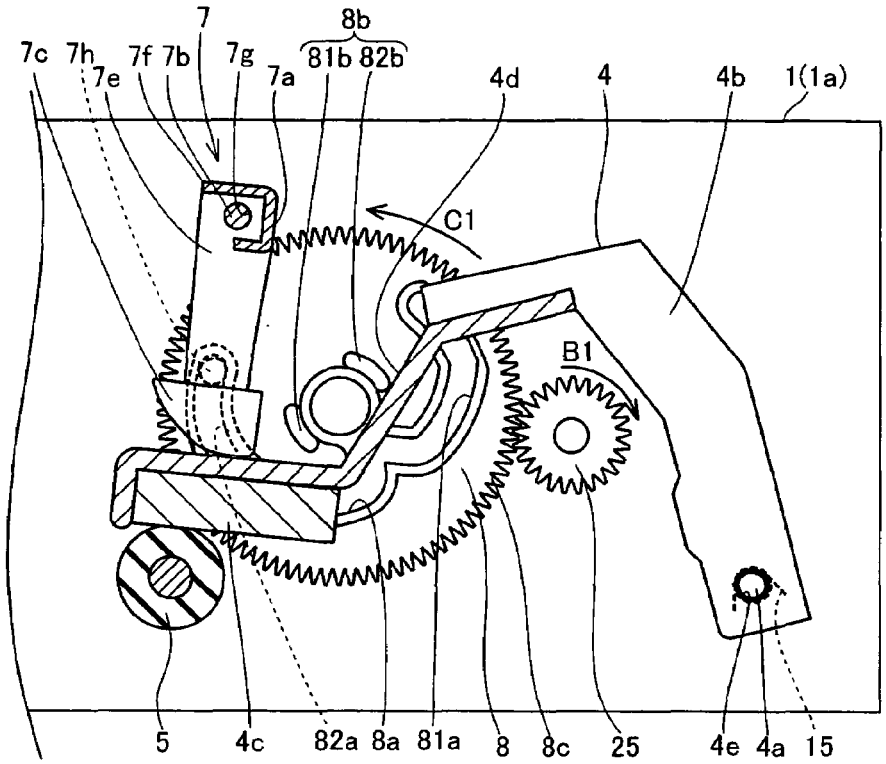

As shown in FIGS. 8 and 9, the print head 4 has a support shaft 4*a* serving as the rotation center of the print head 4, an arm 4*b*, a print head 4*c*, a heat sink 4*d* for radiating heat from the print head 4*c* and a support hole 4*e*. As shown in FIG. 3, the print head 4 is mounted inside the first and second side surfaces 1*a* and 1*b* of the chassis 1 rotatably about the support shaft 4*a*. As shown in FIGS. 8 and 9, the torsion coil spring 15 is mounted on a portion of the support shaft 4*a* of the print head 4 closer to the first side surface 1*a* of the chassis 1. This torsion coil spring 15 has a function of urging the print head 4 to separate from the platen roller 5.

Figure 4:
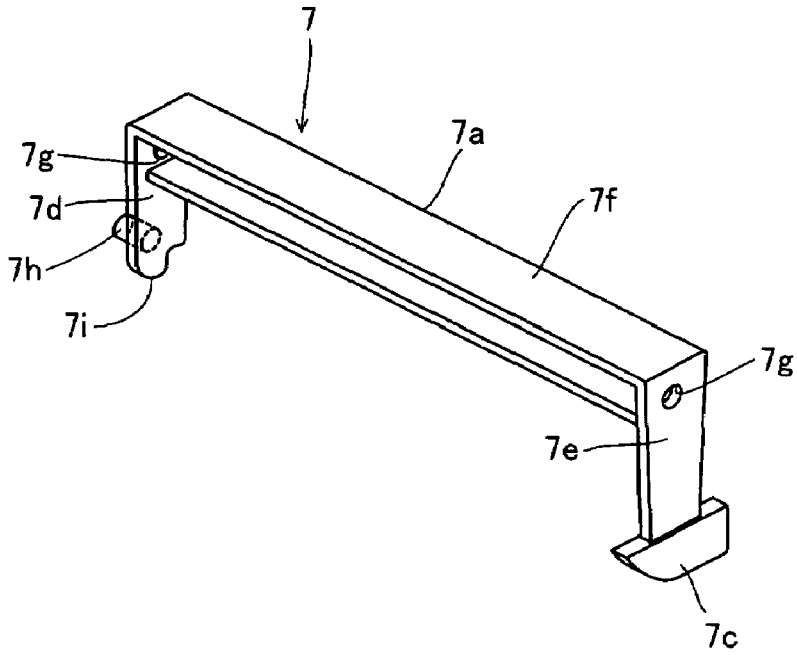
FIG. 4 is a perspective view of a pressing member of the thermal transfer printer according to the embodiment shown in FIG. 1.

As shown in FIGS. 1 to 3, the pressing member 7 has a rotary member 7*a*, a deflectable support rod 7*b* of a piano wire having a diameter of about 3 mm and a resin cap 7*c*. As shown in FIG. 4, the rotary member 7*a* of the pressing member 7 is a U-shaped element including a first side surface 7*d*, a second side surface 7*e* and a coupling portion 7*f* coupling the first and second side surfaces 7*d* and 7*e* with each other. The first and second side surfaces 7*d* and 7*e* of the rotary member 7*a* are provided with holes 7*g* for receiving the support rod 7*b* respectively. The first side surface 7*d* of the rotary member 7*a* is provided with a cam pin 7*h* engaging with a cardioid cam 8*a* (see FIGS. 1 to 3, 8 and 9), formed by a cardioid cam groove, of the drive cam 8 to which driving force is transmitted from the motor 18. The first side surface 7*d* is further provided on an end thereof with a contact portion 7*i* coming into contact with either one of a pair of protrusions 8*b* provided on the drive cam 8. The resin cap 7*c* is mounted on an end of the second side surface 7*e* of the rotary member 7*a*. This cap 7*c* is so provided as to come into contact with the upper portion of the heat sink 4*d* of the print head 4. As shown in FIG. 3, the height h1 of a portion located between the bottom surface of the cap 7*c* and the center of the hole 7*g* of the second side surface 7*e* of the rotary member 7*a* is larger by about 2.4 mm than the height h2 of a portion located between the upper portion of the heat sink 4*d* and the centers of the receiving holes 1*e* of the chassis 1 in pressing, so that the support rod 7*b* is deflected by about 2.4 mm upward when the print head 4 is pressed against the platen roller 5.

Figure 7:
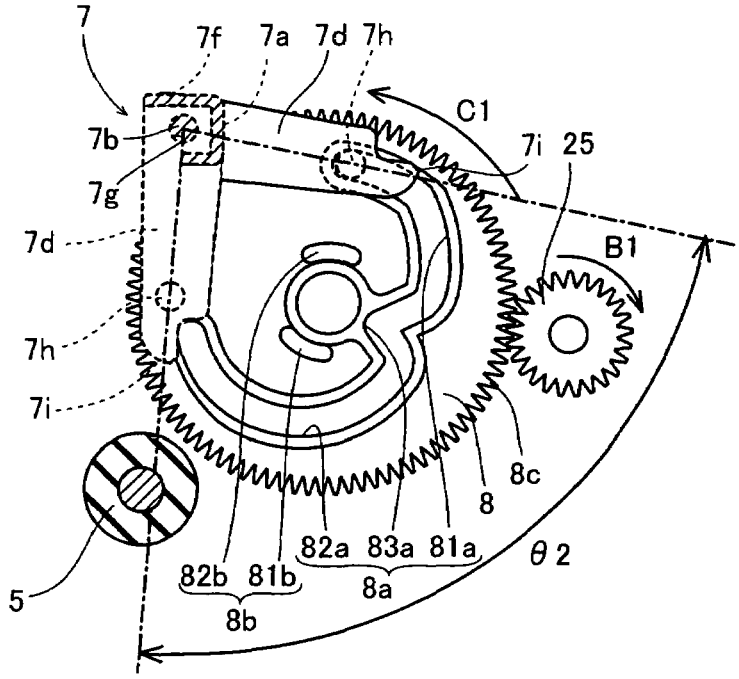
FIG. 7 is a sectional view for illustrating the rotational angle of the pressing member of the thermal transfer printer according to the embodiment shown in FIG. 1.

According to this embodiment, the drive cam 8 includes the cardioid cam 8*a* formed by the cardioid cam groove engaging with the cam pin 7*h* of the pressing member 7, the pair of riblike protrusions 8*b* and a gear 8*c*, as shown in FIG. 7. The protrusions 8*b* are examples of the "movement control member" in the present invention, and the gear 8*c* is an example of the "first gear" in the present invention. The cardioid cam 8*a* is provided on the side surface of the drive cam 8 in a grooved manner. This cardioid cam 8*a* includes a first cam 81*a* and a second cam 82*a* moving the cam pin 7*h* of the pressing member 7 from the outer periphery of the drive cam 8 toward the inner periphery thereof and from the inner periphery of the drive cam 8 toward the outer periphery thereof respectively when driving the pressing member 7 to press the print head 4 against the platen roller 5 and a coupling portion 83*a* coupling the first and second cams 81*a* and 82*a* with each other.

According to this embodiment, the pair of protrusions 8*b* are integrally provided on the drive cam 8 to protrude from the side surface of the drive cam 8 with a prescribed height, as shown in FIGS. 7 to 11, 13 and 15. The protrusions 8*b* include first and second protrusions 81*b* and 82*b*. The first and second protrusions 81*b* and 82*b* are arranged on the side surface of the drive cam 8 to be opposed to each other through the camshaft (rotation center) of the drive cam 8. The first protrusion 81*b* restrains the cam pin 7*h*, coming into contact with the contact portion 7*i* of the pressing member 7 on the position of the coupling portion 83*a*, from moving toward the second cam 82*a*. On the other hand, the second protrusion 82*b* restrains the cam pin 7*h*, coming into contact with the contact portion 7*i* of the pressing member 7 on the position of the coupling portion 83*a*, from moving toward the first cam 81*a*. The gear 8*c* is provided on the outer periphery of the drive cam 8, and meshes with the small diameter gear 25 for rotating the drive cam 8.

Figure 6:
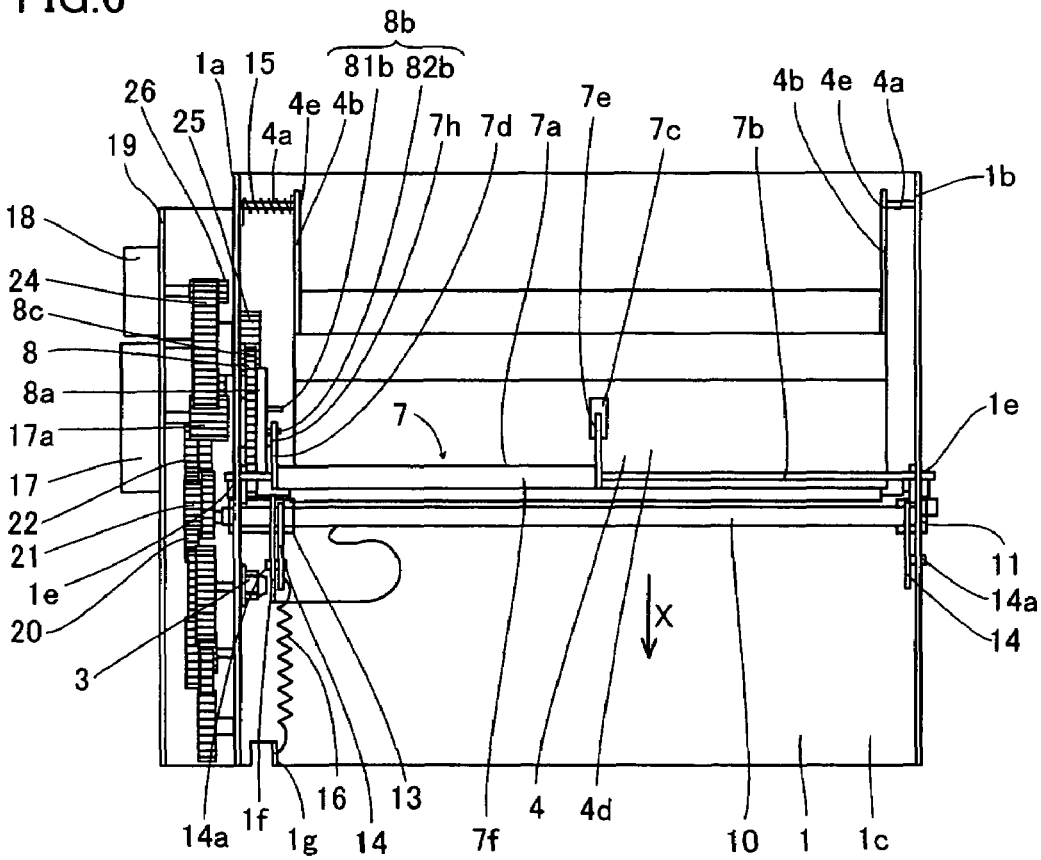
FIG. 6 is a plan view of the thermal transfer printer according to the embodiment shown in FIG. 1.

As shown in FIGS. 2 and 3, the metal feed roller 9 is provided with a gear receiving portion 9*a* (see FIG. 5) and a paper carrier 9*b*. The feed roller 9 is rotatably supported by the feed roller bearings 11 and 12. As shown in FIGS. 5 and 6, the gear receiving portion 9*a* of the feed roller 9 is fitted into the feed roller gear 20 in an unidling manner. A projecting portion having a prescribed height is formed on the surface of the paper carrier 9*b* of the metal feed roller 9 by component rolling. Thus, the paper can be correctly carried with the paper carrier 9*b* of the feed roller 9.

As shown in FIGS. 2 and 3, the metal press roller 10 is rotatably supported by press roller bearings 13. These press roller bearings 13 are mounted on the bearing support plates 14 provided inside the bent section 1*f* formed on the bottom surface 1*c* of the chassis 1 and the second side surface 1*b* respectively. A second end of the tension coil spring 16 for urging the press roller 10 toward the feed roller 9 is mounted on a spring receiving portion 14*b* of the corresponding bearing support plate 14.

As shown in FIG. 5, the driving force of the motor 17, mounted on the motor bracket 19, for driving the feed roller 9 and the take-up reel 3 is transmitted to the feed roller gear 20 and the gear 3*a* of the take-up reel 3 through the intermediate gears 22 and 23. Further, the driving force of the motor 18 for rotating the drive cam 8 driving the pressing member 7 is transmitted to the drive cam 8 through a motor gear 18*a*, the intermediate gear 24 and the small diameter gear 25.

A print operation of the thermal transfer printer according to the embodiment of the present invention is now described with reference to FIGS. 2, 3, 5, 6, 8 and 9. First, the motor 18 is driven to rotate the motor gear 18*a* mounted on the shaft of the motor 18 along arrow A1 in FIG. 5. Thus, the intermediate gear 24 and the small diameter gear 25 rotate along arrow B1 in FIG. 5. Following the rotation of the small diameter gear 25 along arrow B1, the drive cam 8 rotates along arrow C1 shown in FIGS. 8 and 9, so that this rotation of the drive cam 8 is transmitted to the cam pin 7*h* of the pressing member 7 engaging with the cardioid cam 8*a* provided on the drive cam 8. Thus, the rotary member 7*a* of the pressing member 7 rotates about the support rod 7*b*, thereby rotating the pressing member 7 from a horizontal state (see FIG. 8) to a vertical state (see FIG. 9) about the support rod 7*b*. In the vertical state (see FIG. 9) of the pressing member 7, the support rod 7*b* is so deflected upward that the cap 7*c* provided on the end of the second side surface 7*e* of the rotary member 7*a* of the pressing member 7 presses the upper portion of the heat sink 4*d* of the print head 4.

Further, the motor 17 for driving the feed roller 9 and the take-up reel 3 is driven to rotate a motor gear 17*a* mounted on the shaft of the motor 17 along arrow A2 in FIG. 5, thereby rotating the feed roller gear 20 along arrow B2 in FIG. 5 through the intermediate gears 22 and 23. Thus, the feed roller 9 rotates along arrow B2 in FIG. 2, thereby carrying the paper (not shown) in a paper carrying direction (along arrow X in FIGS. 2 and 6) in printing. At this time, the rocking gear 21 meshes with the gear 3*a* of the take-up reel 3 as shown in FIG. 5, for rotating the gear 3*a* of the take-up reel 3 along arrow C2 in FIG. 5. Thus, the take-up bobbin (not shown) engaging with the take-up reel 3 also rotates, thereby taking up the ink ribbon wound on the same and the feed bobbin. In this state of carrying the paper and the ink ribbon, the cap 7*c* mounted on the second side surface 7*e* of the rotary member 7*a* of the pressing member 7 presses the upper portion of the heat sink 4*d* of the print head 4 (see FIG. 9), thereby pressing the print head 4*c* of the print head 4 against the platen roller 5 through the paper and the ink ribbon. In this state, the thermal transfer printer performs printing with the print head 4*c* while carrying the paper and the ink ribbon.

Rotation of the pressing member 7 with the drive cam 8 of the thermal transfer printer according to the embodiment of the present invention is now described with reference to FIGS. 7 to 15. First, the rotational angle of the pressing member 7 with the groove-shaped cardioid cam 8*a* provided on the drive cam 8 is described. When the drive cam 8 rotates along arrow C1 as shown in FIG. 7, the cam pin 7*h* provided on the pressing member 7 moves from an outer peripheral portion of the drive cam 8 corresponding to an end of the first cam 81*a* of the cardioid cam 8*a* provided on the drive cam 8 toward another outer peripheral portion of the drive cam 8 corresponding to an end of the second cam 82*a* of the cardioid cam 8*a* through the coupling portion 83*a* of the cardioid cam 8*a* located on the inner periphery of the drive cam 8. Thus, the pressing member 7 is rotatable about the support rod 7*b* by an angle θ2 substantially corresponding to the diameter of the drive cam 8.

Figure 10:
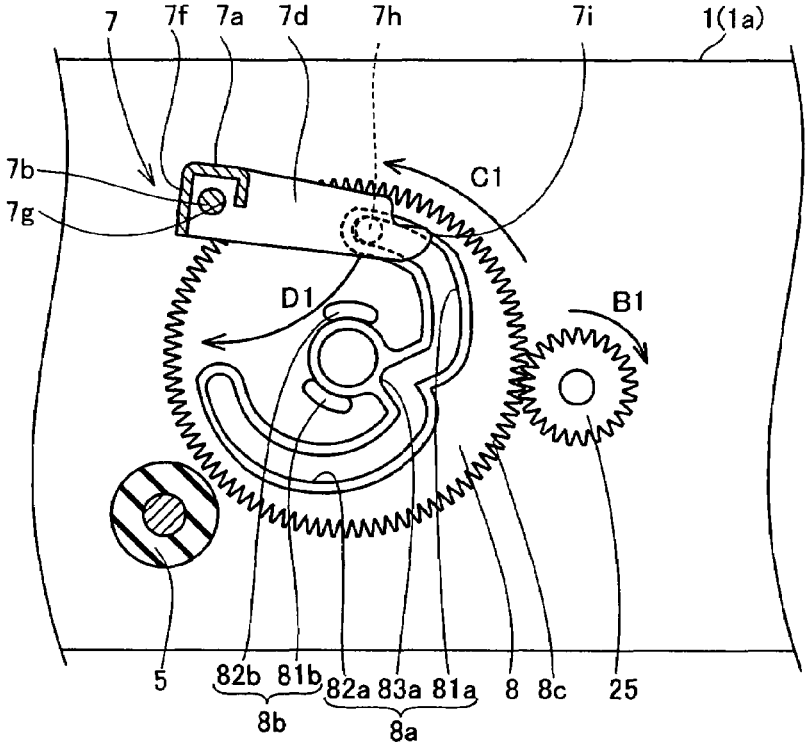
FIGS. 10 to 15 are sectional views for illustrating rotation of the pressing member of the thermal transfer printer according to the embodiment shown in FIG. 1.

The rotation of the pressing member 7 with the drive cam 8 is now described in more detail. In an initial state, the cam pin 7*h* of the pressing member 7 engaging with the cardioid cam 8*a* is on the outer peripheral portion of the drive cam 8 corresponding to the end of the firs cam 81*a* of the cardioid cam 8*a,* as shown in FIGS. 8 and 10. In the initial state shown in FIGS. 8 and 10, the pressing member 7 is close to the horizontal state, and the print head 4 is separated from the platen roller 5 by the torsion coil spring 15.

When the drive cam 8 rotates along arrow C1 from the state shown in FIG. 8, the cam pin 7*h* of the pressing member 7 engaging with the cardioid cam 8*a* moves from the outer peripheral portion of the drive cam 8 toward the coupling portion 83*a* of the cardioid cam 8*a* located on the inner periphery of the drive cam 8 along the first cam 81*a* of the cardioid cam 8*a*. Thus, the pressing member 7 rotates about the support rod 7*b* along arrow D1 in FIG. 10, to result in the state shown in FIG. 11.

Figure 11:
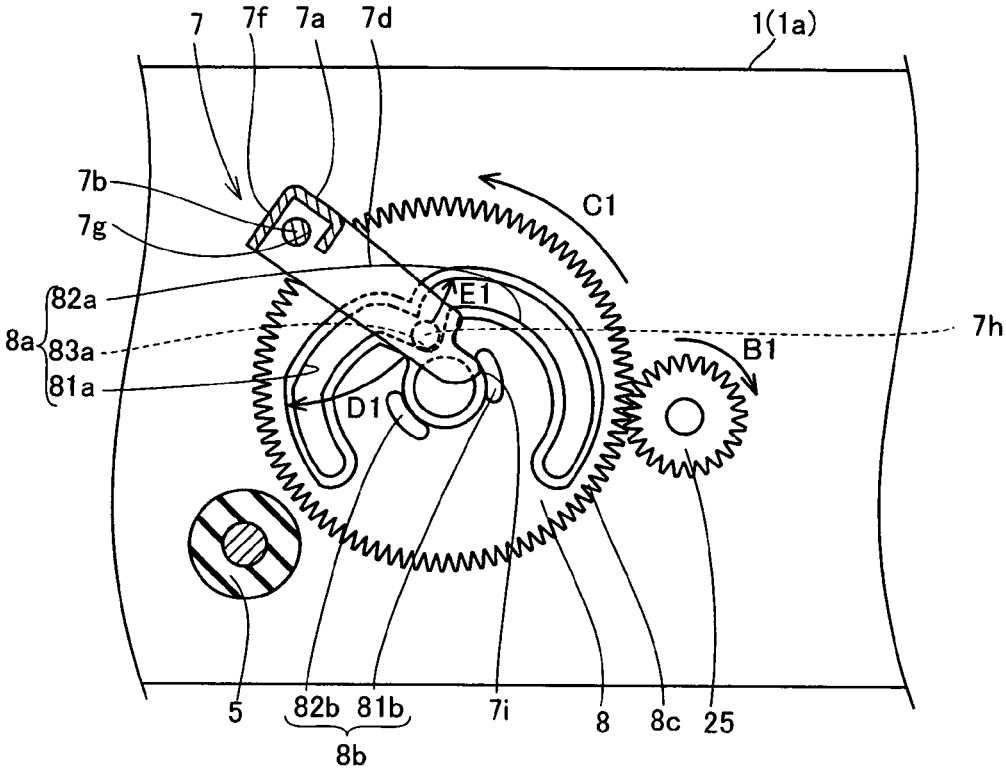
Figure 12:
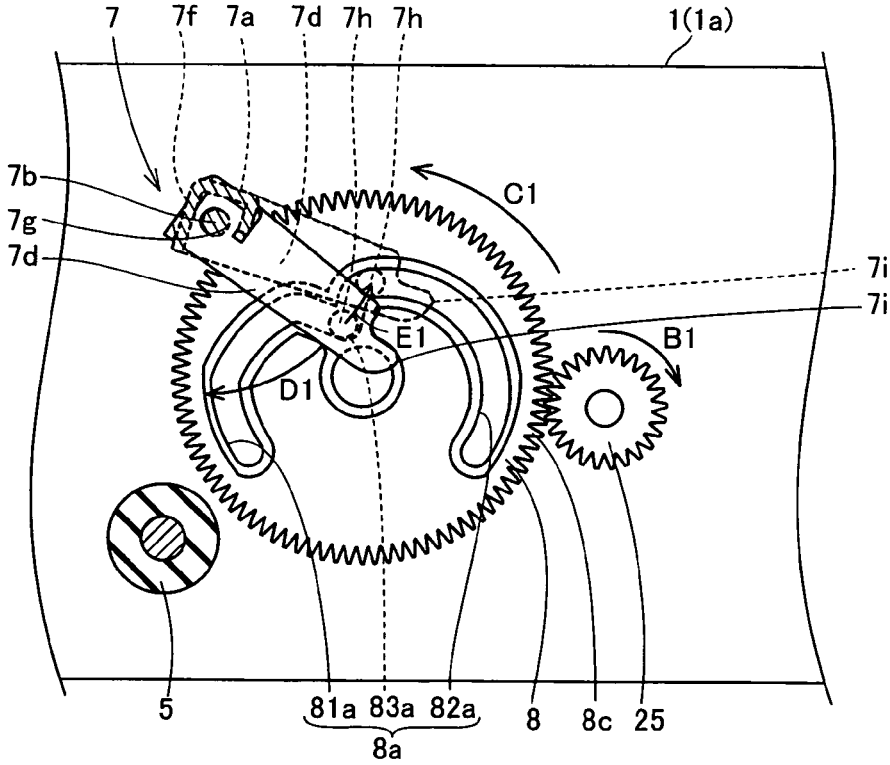

According to this embodiment, the contact portion 7*i* of the pressing member 7 and the first protrusion 81*b* provided on the drive cam 8 come into contact with each other in the state shown in FIG. 11. When positioned on the coupling portion 83*a* of the cardioid cam 8*a,* the cam pin 7*h* of the pressing member 7 is released from the cardioid cam 8*a*. If no protrusions 8*b* are provided on the drive cam 8, therefore, the cam pin 7*h* of the pressing member 7 moves along arrow E1 as shown in FIG. 12 when external force is applied to the pressing member 7, to prevent the pressing member 7 from normal rotation. According to this embodiment, therefore, the drive cam 8 is provided with the first protrusion 81*b* and the pressing member 7 is provided with the contact portion 7*i* so that the contact portion 7*i* of the pressing member 7 and the first protrusion 81*b* come into contact with each other, thereby restraining the cam pin 7*h* of the pressing member 7 from moving along arrow E1 in FIG. 11.

Figure 13:
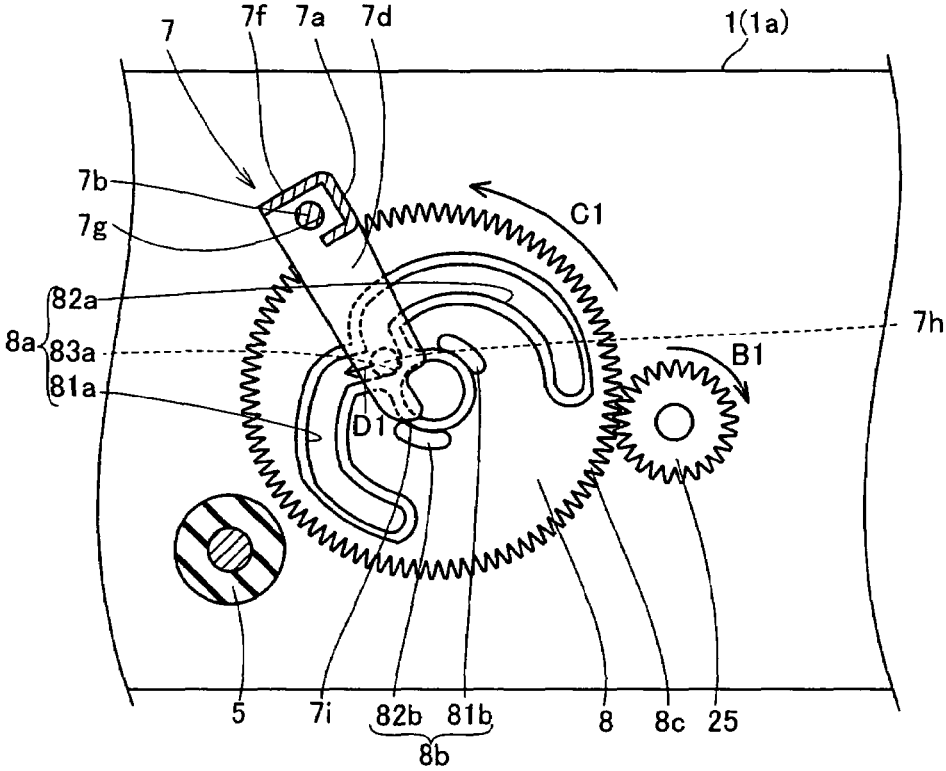
Figure 14:
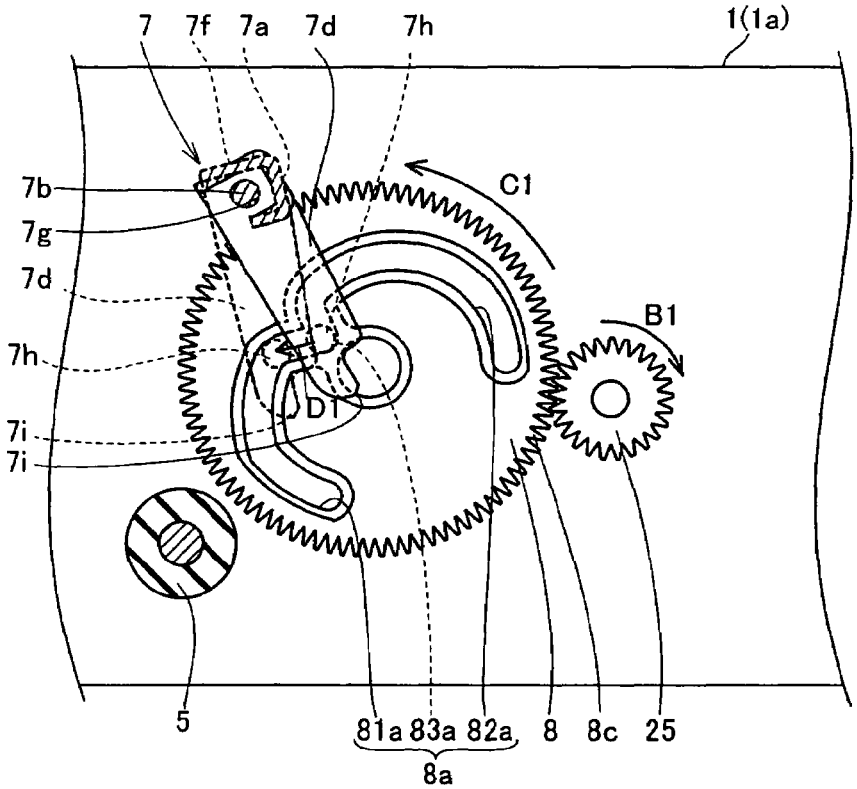
Figure 15:
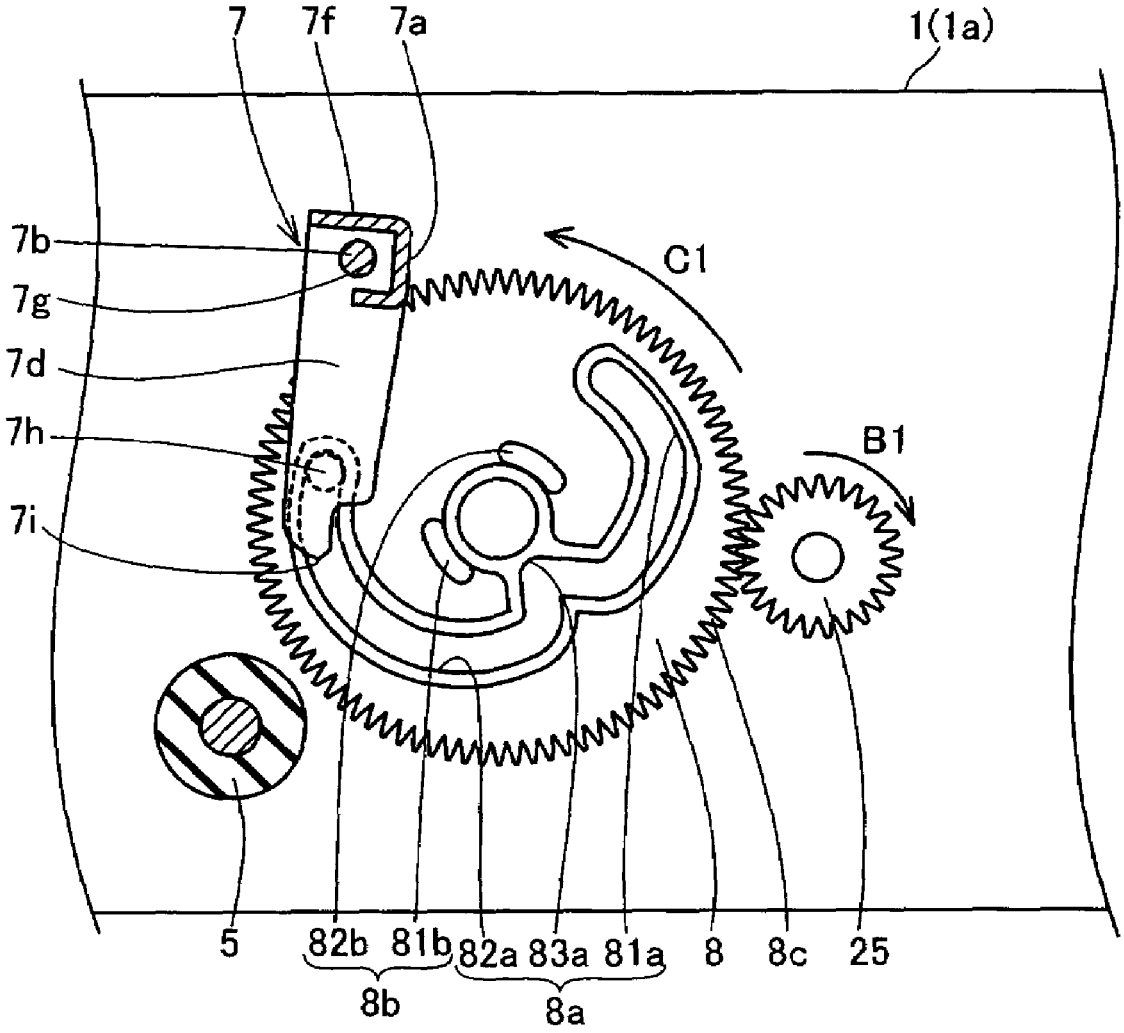

When the drive cam 8 further rotates along arrow C1 from the state shown in FIG. 11, the pressing member 7 rotates about the support rod 7*b* along arrow D1, to result in the state shown in FIG. 13. According to this embodiment, the contact portion 7*i* of the pressing member 7 and the second protrusion 82*b* provided on the drive cam 8 come into contact with each other in the state shown in FIG. 13. When positioned on the coupling portion 83*a* of the cardioid cam 8*a,* the cam pin 7*h* of the pressing member 7 is released from the cardioid cam 8*a*. If no protrusions 8*b* are provided on the drive cam 8, therefore, the cam pin 7*h* of the pressing member 7 moves along arrow D1 as shown in FIG. 14 when external force is applied to the pressing member 7, to prevent the pressing member 7 from normal rotation. According to this embodiment, therefore, the drive cam 8 is provided with the second protrusion 82*b* and the pressing member 7 is provided with the contact portion 7*i* so that the contact portion 7*i* of the pressing member 7 and the second protrusion 82*b* come into contact with each other, thereby restraining the cam pin 7*h* of the pressing member 7 from moving along arrow D1 in FIG. 13.

When the drive cam 8 further rotates along arrow C1 from the state shown in FIG. 13, the cam pin 7*h* of the pressing member 7 moves from the coupling portion 83*a* of the cardioid cam 8*a* located on the inner periphery of the drive cam 8 toward the outer peripheral portion of the drive cam 8 corresponding to the end of the second cam 82*a* along the second cam 82*a* of the cardioid cam 8*a*. Thus, the pressing member 7 rotates about the support rod 7*b,* to approach the vertical state. When approaching the vertical state, the pressing member 7 presses the print head 4 against the platen roller 5 (see FIG. 9).

In order to release the pressing member 7 from the state pressing the print head 4 against the platen roller 5, the drive cam 8 rotates oppositely to the aforementioned operation for pressing the pressing member 7.

According to this embodiment, as hereinabove described, the drive cam 8 includes the cardioid cam 8*a* engaging with the cam pin 7*h* provided on the pressing member 7 so that the cam pin 7*h* of the pressing member 7 moves from the outer peripheral portion of the drive cam 8 corresponding to the end of the first cam 81*a* toward the inner periphery of the drive cam 8 corresponding to the position of the coupling portion 83*a* and further moves from the inner periphery of the drive cam 8 toward the outer peripheral portion of the drive cam 8 corresponding to the end of the second cam 82*a* along the second cam 82*a*, whereby the pressing member 7 can be rotated at a rotational angle substantially corresponding to the diameter of the drive cam 8. Thus, the rotational angle of the pressing member 7 can be rendered larger than that of a general cam, whereby the pressing member 7 pressing the print head 4 against the platen roller 5 can be rotated at the large rotational angle with the drive cam 8. Further, the drive cam 8 includes the movement control member for restraining the cam pin 7*h,* reaching the coupling portion 83*a* of the cardioid cam 8*a,* from moving by force other than that of the drive cam 8, whereby the cam pin 7*h* can be restrained from moving (deviating) on the position of the coupling portion 83*a* where the cam pin 7*h* is released from the cardioid cam 8*a*. Thus, the cam pin 7*h* can undeviatingly move along the cardioid cam 8*a* also when external force other than that of the drive cam 8 is applied thereto.

According to this embodiment, as hereinabove described, the first and second protrusions 81*b* and 82*b* are provided for restraining the cam pin 7*h* from moving toward the second and first cams 82*a* and 81*a* on the coupling portion 83*a* of the cardioid cam 8*a* respectively, whereby the cam pin 7*h* of the pressing member 7 can be restrained from moving on each of the two positions where the cam pin 7*h* is released from the cardioid cam 8*a*. Thus, the cam pin 7*h* can be restrained from moving by force other than that of the drive cam 8 on the two positions where the cam pin 7*h* is released from the cardioid cam 8*a,* whereby the cam pin 7*h* can be more correctly moved along the cardioid cam 8*a* capable of obtaining a large rotational angle. Consequently, the pressing member 7 can be more correctly rotated at a large rotational angle, for more correctly pressing the print head 4 against the platen roller 5 at a large rotational angle.

According to this embodiment, as hereinabove described, the protrusions 8*b* consisting of the first and second protrusions 81*b* and 82*b* are so integrally formed with the drive cam 8 that the number of components can be inhibited from increase despite the provision of the protrusions 8*b* consisting of the first and second protrusions 81*b* and 82*b*.

According to this embodiment, as hereinabove described, the cardioid cam 8*a* is constituted of the cardioid cam groove provided on the side surface of the drive cam 8 while the gear 8*c* is formed on the outer periphery of the drive cam 8 so that the drive cam 8 can be employed as a gear, whereby the driving force of the motor 18 can be easily transmitted to the drive cam 8.

Although the present invention has been described and illustrated in detail, it is clearly understood that the same is by way of illustration and example only and is not to be taken by way of limitation, the spirit and scope of the present invention being limited only by the terms of the appended claims.

For example, while the aforementioned embodiment is present invention is applied to the thermal transfer printer employed as an exemplary image generating apparatus, the present invention is not restricted to this but is also applicable to an image generating apparatus other than the thermal transfer printer so far as the image generating apparatus comprises a drive cam including a print head and a cardioid cam.

While the drive cam is rotated with the small diameter gear in the aforementioned embodiment, the present invention is not restricted to this but the drive cam may alternatively be directly rotated with a motor or the like.

While the cardioid cam is formed by the cardioid groove in the aforementioned embodiment, the present invention is not restricted but the cardioid cam may alternatively be formed by a structure other than the groove, so far as the same has the function of the cardioid cam.

While the pair of protrusions (first and second protrusions) are provided on the drive cam in the aforementioned embodiment, the present invention is not restricted to this but the drive cam may alternatively be provided with one or at least three protrusions.

While the protrusions are integrally provided on the drive cam in the aforementioned embodiment, the present invention is not restricted to this but protrusions provided independently of the drive cam may alternatively be mounted on the drive cam.

While the protrusions serving as the movement control members are integrally provided on the side surface of the drive cam in order to restrain the cam pin from moving by external force other than that of the drive cam in the aforementioned embodiment, the present invention is not restricted to this but the cam pin may alternatively be restrained from moving with a spring or the like having urging force superior to the external force. Further alternatively, the cam pin may be restrained from moving with another member different in shape from the protrusions.

What is claimed is:

1. An image generating apparatus comprising:

a print head for printing;

a platen roller opposed to said print head;

a rotatably supported pressing member, having a cam pin, for pressing said print head against said platen roller by pressing the upper portion of said print head; and a drive cam for driving said pressing member, wherein said drive cam includes a cardioid cam engaging with said cam pin provided on said pressing member and a movement control member for restraining said cam pin from moving by force other than that of said drive cam when said cam pin reaches a prescribed position of said cardioid cam, and the cardioid cam includes a first cam configured to move the cam pin provided on the pressing member from the outer periphery of the drive cam toward the inner periphery thereof when driving the pressing member and move the cam pin oppositely when releasing the pressing member, a second cam, separately provided from the first cam, configured to move the cam pin provided on the pressing member from the inner periphery of the drive cam toward the outer periphery thereof when driving the pressing member and move the cam pin oppositely when releasing the pressing member, and a coupling portion coupling an end of the first cam and an end of the second cam with each other.

2. The image generating apparatus according to claim 1, wherein said movement control member of said drive cam is a protrusion provided on the side, surface of said drive cam, and said pressing member includes a contact portion coming into contact with said protrusion of said drive cam, so that said contact portion of said pressing member comes into contact with said protrusion thereby restraining said cam pin provided on said pressing member from moving on said prescribed position.

3. The image generating apparatus according to claim 2, wherein said protrusion includes a first protrusion for restraining said cam pin from moving in a first direction on said prescribed position of said cardioid cam and a second protrusion for restraining said cam pin from moving in a second direction on said prescribed position of said cardioid cam.

4. The image generating apparatus according to claim 2, wherein said protrusion is integrally formed with said drive cam.

5. The image generating apparatus according to claim 1, wherein said cardioid cam includes a cardioid cam groove provided on the side surface of said drive cam, and a first gear is formed on the outer periphery of said drive cam.

6. The image generating apparatus according to claim 3, wherein said prescribed position for said cam pin where said contact portion of said pressing member comes into contact with said protrusion is the position of said coupling portion of said cardioid cam.

7. The image generating apparatus according to claim 3, wherein said first protrusion and said second protrusion are arranged on the side surface of said drive cam to be opposed to each other through the rotation center of said drive cam.

8. The image generating apparatus according to claim 4, wherein said drive cam is made of resin.

9. The image generating apparatus according to claim 5, further comprising a second gear meshing with said first gear formed on the outer periphery of said drive cam, for rotating said drive cam by transmitting rotation of said second gear to said first gear of said drive cam.

10. An image generating apparatus comprising:

a print head for printing;

a platen roller opposed to said print head;

a rotatably supported pressing member, having a cam pin, for pressing said print head against said platen roller by pressing the upper portion of said print head; and a drive cam for driving said pressing member, wherein said drive cam includes a cardioid cam engaging with said cam pin provided on said pressing member and a movement control member for restraining said cam pin from moving by force other than that of said drive cam when said cam pin reaches a prescribed position of said cardioid cam, said movement control member of said drive cam is a protrusion, integrally provided on the side surface of said drive cam, including a first protrusion for restraining said cam pin from moving in a first direction on said prescribed position of said cardioid cam and a second protrusion for restraining said cam pin from moving in a second direction on said prescribed position of said cardioid cam, said pressing member includes a contact portion coming into contact with said protrusion of said drive cam, so that said contact portion of said pressing member comes into contact with said protrusion thereby restraining said cam pin provided on said pressing member from moving on said prescribed position, said cardioid cam includes a cardioid cam groove provided on the side surface of said drive cam, a first gear is formed on the outer periphery of said drive cam, and the cardioid cam includes a first cam configured to move the cam pin provided on the pressing member from the outer periphery of the drive cam toward the inner periphery thereof when driving the pressing member and move the cam pin oppositely when releasing the pressing member, a second cam, separately provided from the first cam, configured to move the cam pin provided on the pressing member from the inner periphery of the drive cam toward the outer periphery thereof when driving the pressing member and move the cam pin oppositely when releasing the pressing member, and a coupling portion coupling an end of the first cam and an end of the second cam with each other.

11. The image generating apparatus according to claim 10, wherein said prescribed position for said cam pin where said contact portion of said pressing member comes into contact with said protrusion is the position of said coupling portion of said cardioid cam.

12. The image generating apparatus according to claim 10, wherein said first protrusion and said second protrusion are arranged on the side surface of said drive cam to be opposed to each other through the rotation center of said drive cam.

13. The image generating apparatus according to claim 10, wherein said drive cam is made of resin.

14. The image generating apparatus according to claim 10, further comprising a second gear meshing with said first gear formed on the outer periphery of said drive cam, for rotating said drive cam by transmitting rotation of said second gear to said first gear of said drive cam.

* * * * *